US010774534B2

(12) United States Patent
Uwai et al.

(10) Patent No.: US 10,774,534 B2
(45) Date of Patent: Sep. 15, 2020

(54) DEFORMED REINFORCING BAR

(71) Applicant: JFE STEEL CORPORATION, Chiyoda-ku, Tokyo (JP)

(72) Inventors: Kiyoshi Uwai, Tokyo (JP); Takashi Iwamoto, Tokyo (JP); Kazukuni Hase, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 200 days.

(21) Appl. No.: 16/076,779

(22) PCT Filed: Feb. 8, 2017

(86) PCT No.: PCT/JP2017/004633
§ 371 (c)(1),
(2) Date: Aug. 9, 2018

(87) PCT Pub. No.: WO2017/138577
PCT Pub. Date: Aug. 17, 2017

(65) Prior Publication Data

US 2019/0048590 A1 Feb. 14, 2019

(30) Foreign Application Priority Data

Feb. 10, 2016 (JP) ..... 2016-023746

(51) Int. Cl.
*E04C 5/06* (2006.01)
*C22C 38/60* (2006.01)
(Continued)

(52) U.S. Cl.
CPC ..... *E04C 5/06* (2013.01); *C21D 6/002* (2013.01); *C21D 6/005* (2013.01); *C21D 6/008* (2013.01);
(Continued)

(58) Field of Classification Search
CPC ..... E04C 5/03
See application file for complete search history.

(56) References Cited

FOREIGN PATENT DOCUMENTS

JP H06288038 A 10/1994
JP 2011208257 A 10/2011
(Continued)

OTHER PUBLICATIONS

May 9, 2017, International Search Report issued in the International Patent Application No. PCT/JP2017/004633.

*Primary Examiner* — Adam Krupicka
(74) *Attorney, Agent, or Firm* — Kenja IP Law PC

(57) ABSTRACT

A high manganese content deformed reinforcing bar having an austenite single phase microstructure has excellent bending workability. A deformed reinforcing bar includes a chemical composition containing, in mass %, C: 0.7% or more and 1.2% or less, Si: 1.0% or less, Mn: 9% or more and 15% or less, Cr: 1.0% or less, P: 0.03% or less, and S: 0.05% or less, the balance consisting of Fe and inevitable impurities; and a microstructure comprising an austenite single phase. The ratio of the difference between the maximum and minimum hardness at a periphery of a cross-section perpendicular to the longitudinal direction with respect to a central average hardness is 15% or less. Two or more ribs extend in the longitudinal direction at equal intervals in a cross-sectional circumferential direction. The ratio of the difference between the maximum and minimum width of the ribs to the minimum width is 50% or less.

4 Claims, 9 Drawing Sheets

(51) Int. Cl.

| | |
|---|---|
| ***E04C 5/03*** | (2006.01) |
| ***C22C 38/38*** | (2006.01) |
| ***C21D 7/10*** | (2006.01) |
| ***C21D 8/08*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/24*** | (2006.01) |
| ***C22C 38/26*** | (2006.01) |
| *C21D 9/00* | (2006.01) |

(52) U.S. Cl.

CPC ..... *C21D 7/10* (2013.01); *C21D 7/105* (2013.01); *C21D 8/08* (2013.01); *C22C 38/002* (2013.01); *C22C 38/02* (2013.01); *C22C 38/04* (2013.01); *C22C 38/24* (2013.01); *C22C 38/26* (2013.01); *C22C 38/38* (2013.01); *C22C 38/60* (2013.01); *E04C 5/03* (2013.01); *C21D 9/00* (2013.01); *C21D 9/0075* (2013.01); *C21D 2211/001* (2013.01)

(56) References Cited

FOREIGN PATENT DOCUMENTS

| | | | |
|---|---|---|---|
| JP | 2012161820 | A | 8/2012 |
| JP | 2014205908 | A | 10/2014 |

DEFORMED REINFORCING BAR

TECHNICAL FIELD

The present disclosure relates to a deformed reinforcing bar used in a reinforced concrete structure. In particular, the present disclosure relates to a high manganese content deformed reinforcing bar that has excellent suppression of out-of-plane deformation during bending and contains 9 mass % or more of Mn.

BACKGROUND

Since the magnetic permeability of high manganese content deformed reinforcing bars that have an austenite microstructure is low, such deformed reinforcing bars are used in locations where the magnetic field due to current cannot be disturbed, such as in reinforced structural members in a magnetic resonance imaging (MRI) room of a hospital. Deformed reinforcing bars are used after being bent into a predetermined shape, such as a hoop, during work at a construction site. FIGS. 1A and 1B illustrate examples of the shape, as seen from the side, of a deformed reinforcing bar bent into an approximately square hoop shape. No problem is posed if the reinforcing bar fits within substantially the same plane, as in FIG. 1B, but if out-of-plane deformation occurs, as in FIG. 1A, the reinforcing bar cannot be disposed on a plane surface. Therefore, deformed reinforcing bars are required not to exhibit out-of-plane deformation.

Considering adhesion to concrete, a deformed reinforcing bar is formed as a round bar material having ribs extending in the longitudinal direction around the bar and having predetermined joints. FIG. 2 illustrates an example shape. The diameter of the portion excluding the joints and the ribs, the height of the joints, the distance between joints, the total width of the ribs, and the angle between the joints and axis are determined by JIS standards.

To improve the bending workability of a deformed reinforcing bar, JP H06-288038 A (PTL 1), for example, proposes a reinforcing bar that has joints skewed relative to the axis of the reinforcing bar, with the amount of uplift during bending being improved by controlling the shape and placement of the joints.

JP 2011-208257 A (PTL 2) discloses a high-strength reinforcing bar that has four ribs continuous in the longitudinal direction, arranged at 90° intervals in the circumferential direction of the reinforcing bar, and that has joints connecting ribs adjacent in the circumferential direction. In this reinforcing bar, the bending workability and concrete adhesion are improved by controlling the shape of the ribs and the joints.

CITATION LIST

Patent Literature

PTL 1: JP H06-288038 A
PTL 2: JP 2011-208257 A

SUMMARY

Technical Problem

Young's modulus is lower, however, in high manganese content steel having an austenite microstructure than in typical steel, and work hardening characteristics are significant. Hence, out-of-plane deformation occurs more easily than in typical steel and cannot be suppressed even when using the techniques disclosed in PTL 1 and PTL 2. Each time out-of-plane deformation occurs, correction is necessary at the construction site for placement within a constant cross-section. Such correction represents a large burden.

In response to these technical issues, the present disclosure provides a deformed reinforcing bar that has excellent bending workability capable of suppressing out-of-plane deformation during bending even when configured as a high manganese content deformed reinforcing bar having an austenite single phase microstructure.

Solution to Problem

To this end, we performed extensive research into the factors that affect the occurrence of out-of-plane deformation of a high manganese content deformed reinforcing bar and made the following discoveries.

When bending a round bar, compression strain on the neutral axis inside and tensile strain on the neutral axis outside occur in a round bar cross-section relative to the bending neutral axis, but symmetry is preserved above and below the neutral axis. However, since a deformed reinforcing bar includes joints and ribs, the local strain distribution is uneven around the joints and the ribs, and depending on the shape of the joints and the ribs or the bending position, the symmetry in the strain distribution above and below the neutral axis in a deformed reinforcing bar cross-section changes. The symmetry in the vertical strain distribution relative to the neutral axis in this cross-section breaks down significantly, and due to a certain difference or greater in the strain, the out-of-plane deformation (deformation upwards or downwards in this case) becomes prominent.

Accordingly, keeping the joints and ribs of the deformed reinforcing bar as low as possible to approach a round bar shape maintains symmetry in the vertical strain distribution and thus curbs out-of-plane deformation. The adhesion with concrete degrades, however, and the joint height cannot be reduced below the joint height stipulated by JIS. Furthermore, since the sum of strain is determined by the degree of bending, out-of-plane deformation tends not to occur for a low degree of bending, even if the symmetry in the vertical strain distribution breaks down slightly. However, the degree of bending cannot be restricted.

On the other hand, high manganese content steel having an austenite single phase microstructure exhibits far greater work hardening than typical steel, as illustrated in FIG. 3. Consequently, during bending, the uneven distribution of strain caused by the shape around the joints and the ribs induces a significant unevenness in the material strength. As work progresses, the local unevenness in material strength exacerbates the uneven distribution of strain.

For these reasons, as compared to a deformed reinforcing bar of typical steel, a high manganese content deformed reinforcing bar having an austenite microstructure has increased local strain occurring around the joints and ribs during bending due to the characteristically significant work hardening of such a reinforcing bar, and the breakdown in vertical strain symmetry increases. Out-of-plane deformation thus tends to occur.

The present disclosure is based on the above findings and has the following primary features.

1. A deformed reinforcing bar comprising:

a chemical composition containing (consisting of), in mass %,

C: 0.7% or more and 1.2% or less,

Si: 1.0% or less,

Mn: 9% or more and 15% or less,

Cr: 1.0% or less,

P: 0.03% or less, and

S: 0.05% or less, the balance consisting of Fe and inevitable impurities; and a microstructure comprising an austenite single phase; wherein in terms of Vickers hardness, a ratio of a difference between a maximum hardness and a minimum hardness at a periphery of a cross-section perpendicular to the longitudinal direction with respect to a central average hardness is 15% or less, two or more ribs extending in the longitudinal direction are provided at equal intervals in a cross-sectional circumferential direction, and a ratio of a difference between a maximum width and a minimum width of the ribs with respect to the minimum width is 50% or less.

2. The deformed reinforcing bar of 1., wherein the chemical composition further contains, in mass %, one or more of:

V: 1.0% or less, and

Nb: 0.2% or less.

3. The deformed reinforcing bar of 1. or 2., wherein the number of ribs is an even number equal to or greater than four, and a ratio of a difference between a maximum distance and a minimum distance between apices of diagonal ribs with respect to the minimum distance is 5% or less.

Advantageous Effect

According to the present disclosure, the out-of-plane deformation during bending can be suppressed in a high manganese content deformed reinforcing bar having an austenite microstructure.

DETAILED DESCRIPTION

[Chemical Composition]

Figure 1A:
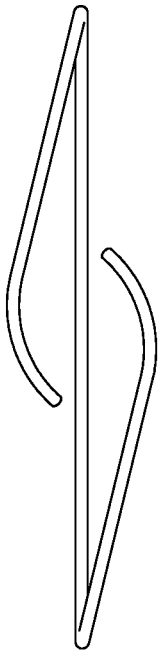
FIGS. 1A and 1B are schematic views, from the side, of a deformed reinforcing bar bent into a hoop shape.
Figure 1B:
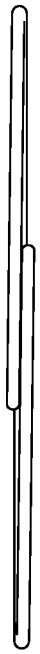

First, the reasons for the aforementioned limitations on the chemical composition of the steel in the present disclosure are explained. Unless specified otherwise, "%" for the content of each component represents "mass %".

C: 0.7% or More and 1.2% or Less

C is an element that stabilizes the austenite phase and is important for obtaining the necessary strength. By setting the C content to 0.7% or more, the necessary strength can be obtained, and the necessary relative magnetic permeability of 1.1 or less as nonmagnetic material can stably be obtained. On the other hand, upon including more than 1.2% of C, the ductility and workability degrade, and the steel tends to crack during bending. Therefore, the C content is set to 0.7% or more and 1.2% or less.

Si: 1.0% or Less

Si acts as a deoxidizer and is also useful as a solid-solution-strengthening element for providing the necessary strength. However, no further effect is obtained upon the Si content exceeding 1.0%, and workability degrades. The Si content is therefore set to 1.0% or less. The case of the Si content being 0% is included.

Mn: 9% or More and 15% or Less

Mn is an element that stabilizes the austenite phase and is important for obtaining the necessary strength. To stably obtain the necessary relative magnetic permeability of 1.1 or less as nonmagnetic material, addition of 9% or more of Mn is necessary. No further effect is obtained, however, upon the Mn content exceeding 15%. The Mn content is therefore set to 9% or more and 15% or less.

Cr: 1.0% or Less

Cr is a useful element for stabilizing the austenite phase and improving strength by solid solution strengthening. However, no further effect is obtained upon the Cr content exceeding 1.0%, and workability degrades.

Hence, the Cr content is set to 1.0% or less.

P: 0.03% or Less

P segregates at the austenite grain boundary, significantly reduces the hot ductility, and tends to cause surface cracking during continuous casting. Therefore, the P content is preferably kept as low as possible, but a content of up to 0.03% is tolerable.

S: 0.05% or Less

S is a useful element for forming MnS in the steel and improving the machinability by cutting, but S also segregates at the grain boundary of austenite and reduces the grain boundary strength, which has the harmful effect of reducing fatigue strength. Hence, the S content is set to 0.05% or less.

The chemical composition of the deformed reinforcing bar according to an embodiment of the present disclosure includes each of the aforementioned components (basic components), Fe, and inevitable impurities.

The chemical composition of the deformed reinforcing bar according to another embodiment of the present disclosure further optionally includes, in addition to the aforementioned basic components, one or more of V: 1.0% or less, and Nb: 0.2% or less. Adding V and/or Nb can further obtain strength stably.

V: 1.0% or Less

V reduces the austenite grain size by precipitation and is a useful element for improving strength. V may therefore be added as required. However, ductility significantly deteriorates upon the V content exceeding 1.0%, and workability degrades. Hence, the V content is set to 1.0% or less.

Nb: 0.2% or Less

Nb also reduces the austenite grain size by precipitation and is a useful element for improving strength. Nb may therefore be added as required. Upon the Nb content exceeding 0.2%, however, the hot ductility significantly deteriorates, and cracks tend to form during continuous casting. Hence, the Nb content is set to 0.2% or less.

The chemical composition of steel preferably consists of the aforementioned basic components and the optionally included components (V, Nb), with the balance consisting of Fe and inevitable impurities.

[Microstructure]

The deformed reinforcing bar of the present disclosure has a microstructure formed by an austenite single phase.

[Hardness Difference]

In the present disclosure, it is important that, in terms of Vickers hardness, the ratio of the difference between the maximum hardness and the minimum hardness at the periphery of a cross-section perpendicular to the longitudinal direction of the deformed reinforcing bar with respect to the central average hardness (hardness difference) be 15% or less. If the hardness difference exceeds 15%, the symmetry of strain in the cross-section breaks down significantly, leading to out-of-plane deformation at the time of bending. The hardness difference can be measured by the method described in the Examples.

No particular limitation is placed on the method of restricting the hardness difference to 15% or less, but this value can be achieved by setting the reduction in area ((cross-sectional area of preceding stage—cross-sectional area of transfer stage)/cross-sectional area of preceding stage×100%), before and after the pass for transfer molding the deformed cross-section with a roller, to be 40% or less for straight bar rolled material directly after hot rolling. In particular, low temperature rolling is directed to obtain strength in austenite steel, and the hardness difference is promoted as the reduction in area increases. The reduction in area is preferably 30% or less.

Figure 4:
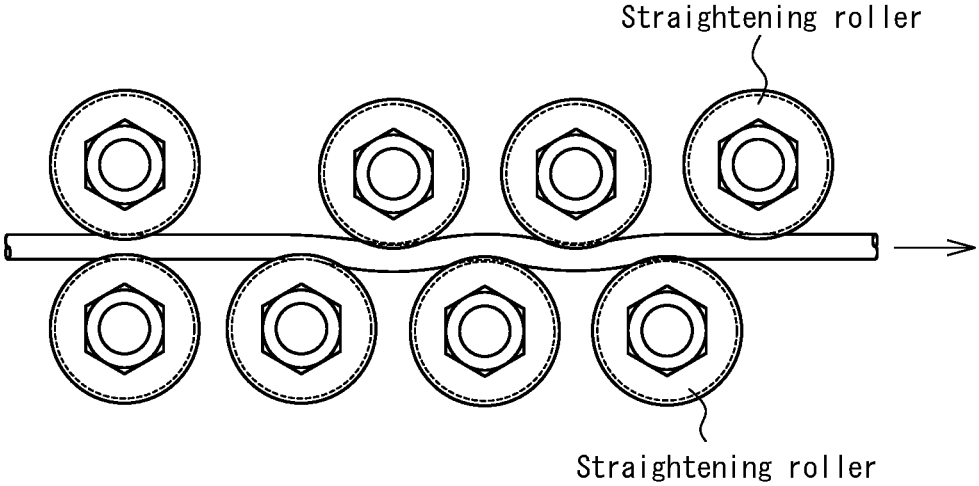
FIG. 4 is a schematic view illustrating an example of the structure of a biaxial roller leveler.
Figure 5:
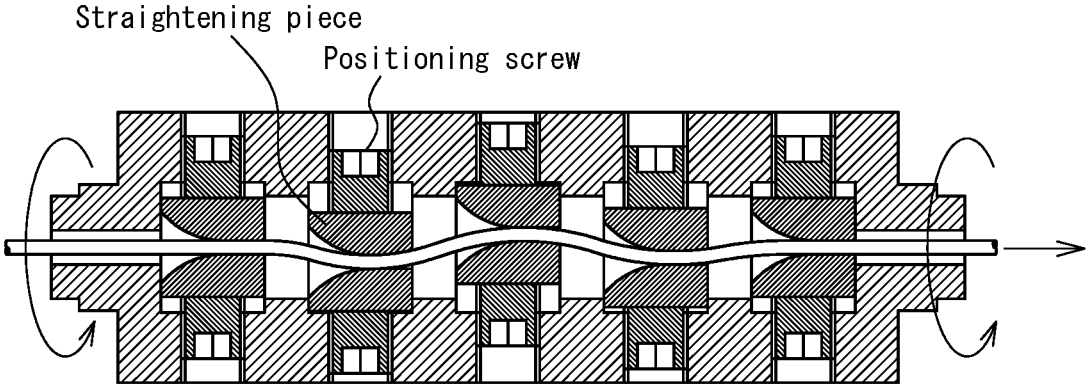
FIG. 5 is a schematic view illustrating an example of the structure of a rotary straightening leveler.

For straightened material, which is used by subjecting a deformed reinforcing bar that is wound into a coil after hot rolling to straightening by cold rolling with a leveler, a biaxial roller leveler such as the one in FIG. 4 or a rotary straightening leveler such as the one in FIG. 5 may be used for straightening, but the difference in cross-sectional hardness after the straightening needs to be controlled to be within the range prescribed in the present disclosure.

At the time of straightening, it should be remembered that since the deformed reinforcing bar is being manufactured to maintain uniformity in the cross-sectional hardness during the hot rolling stage, as described above, precautions are necessary for the material properties not to degrade due to the straightening. For example, when straightening with a biaxial roller leveler, straightening strain becomes distributed unevenly in an apparatus in which the straightening rollers are disposed in one direction (in the example in FIG. 4, the straightening rollers are disposed in one vertical direction from the reinforcing bar). Hence, a leveler in which rollers are disposed at multiple stages in the circumferential direction is preferably used. A rotary straightening leveler is preferred as a straightening apparatus, since during straightening by such a leveler, straightening strain is introduced while the straightening roller is rotating, making it easier to introduce uniform strain in the circumferential direction than with a biaxial roller leveler.

[Shape]

Figure 2:
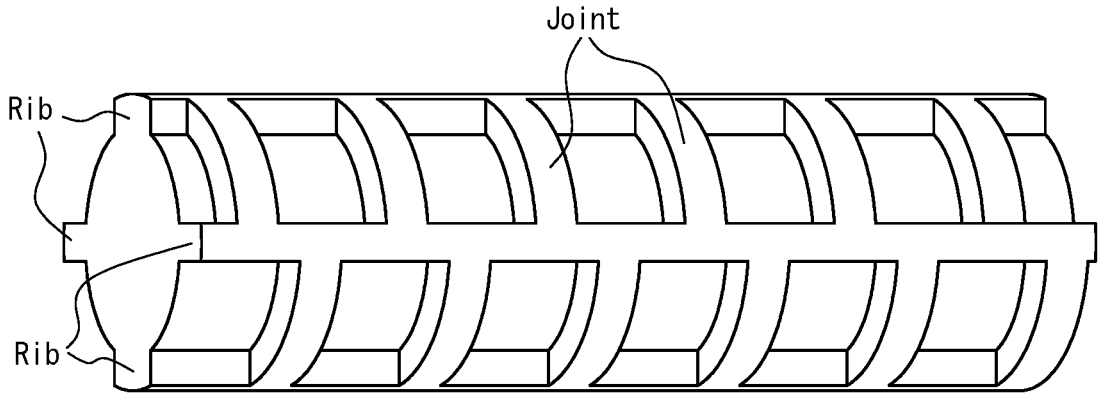
FIG. 2 is a schematic view illustrating an example of the shape of the deformed reinforcing bar.
Figure 3:
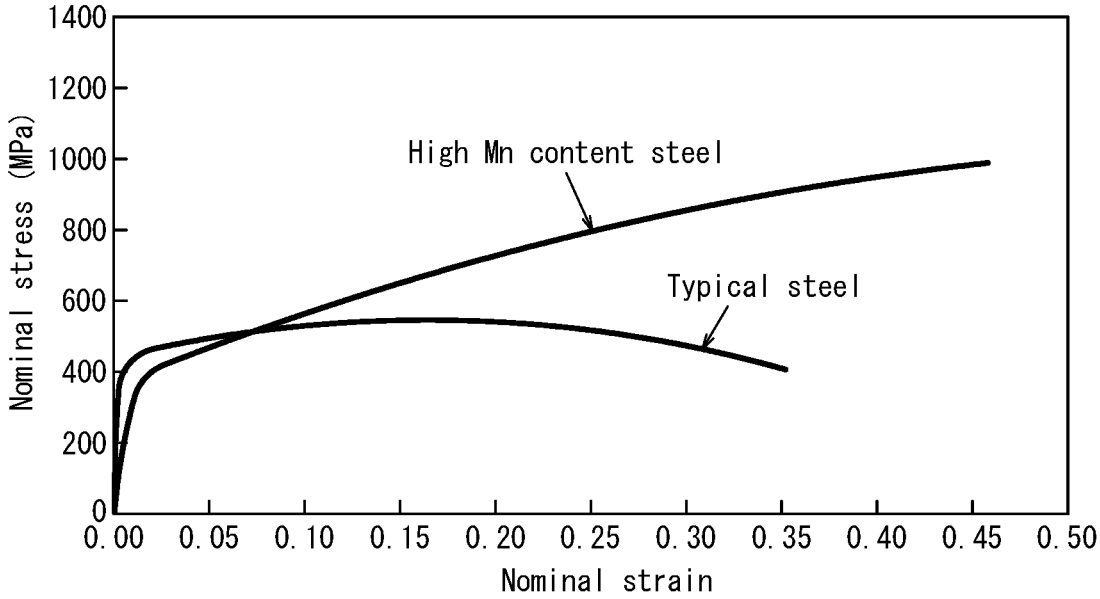
FIG. 3 is a stress/strain curve for high Mn content steel and typical steel.

The reasons for limiting the deformed shape of the reinforcing bar are now described. Two or more ribs extending in the longitudinal direction are provided on the deformed reinforcing bar according to the present disclosure at equal intervals in the cross-sectional circumferential direction. By providing two or more ribs at equal intervals, the uneven distribution of vertical strain during bending can be reduced. For example, in the example reinforcing bar illustrated in FIG. 2, four ribs are provided at 90° intervals. As long as the number of ribs is two or more, any number of ribs may be used, but an even number is preferable to facilitate shape formation by hot rolling. By disposing two ribs at 180° intervals, the symmetry and vertical strain is maintained depending on the bending position, and therefore out-of-plane deformation does not occur if the cross-sectional hardness is as prescribed above. However, since the bending position during actual construction cannot be designated in some cases, the number of ribs is preferably four or greater. On the other hand, while the number of stress concentrators can be reduced and the breakdown in vertical strain symmetry can be mitigated as the number of ribs increases, shape formation by hot rolling becomes difficult if the number of ribs is six or greater. Therefore, an arrangement of four ribs at 90° intervals is more preferable.

[Rib Width Difference]

In the deformed reinforcing bar according to the present disclosure, the ratio of the difference between the maximum width and the minimum width of the ribs with respect to the minimum width (rib width difference) is set to 50% or less. Upon the rib width difference exceeding 50%, the difference in strain occurring locally around each rib increases, and the vertical strain symmetry breaks down, causing out-of-plane deformation. Therefore, by setting the rib width difference to 50% or less, out-of-plane deformation during bending can be suppressed.

[Difference in Distance Between Apices of Diagonal Ribs]

In the deformed reinforcing bar according to the present disclosure, the number of ribs is preferably an even number four or greater, and the ratio of the difference between the maximum distance and the minimum distance between apices of diagonal ribs with respect to the minimum distance (difference in distance between apices of diagonal ribs) is preferably set to 5% or less. If a plurality of pairs of ribs is disposed on diagonal lines and the difference in the distance between apices of the ribs in each pair exceeds 5%, then depending on the bending position, the vertical strain symmetry may break down significantly, and out-of-plane deformation may occur. Therefore, by setting the difference in distance between apices of diagonal ribs to 5% or less, out-of-plane deformation during bending can be further suppressed.

Controlling the chemical composition, microstructure, and rib shape as described above allows the desired deformed reinforcing bar of the present disclosure to be obtained, namely a high manganese content deformed reinforcing bar that has an austenite microstructure, exhibits excellent bending workability with suppressed out-of-plane deformation during bending, and has excellent adhesion to concrete.

Figure 6:
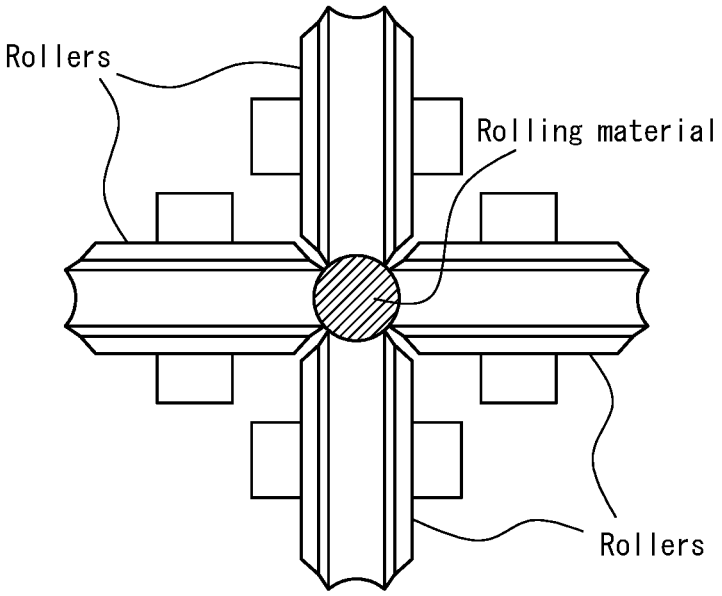
FIG. 6 is a schematic view illustrating an example of a four-roll rolling mill.
Figure 7:
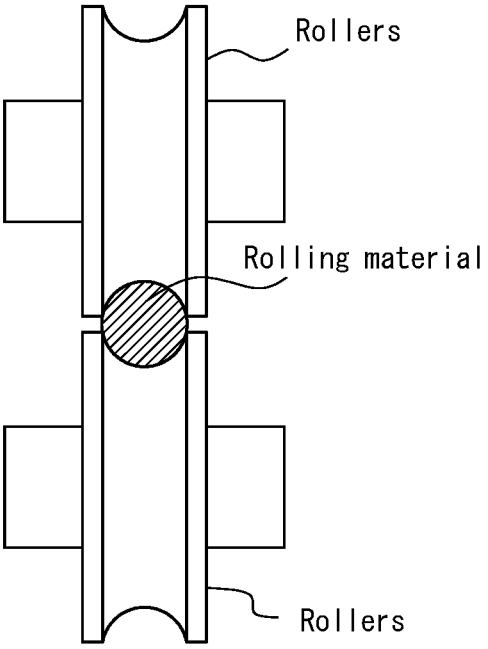
FIG. 7 is a schematic view illustrating an example of a two-roll rolling mill.

As a method for forming predetermined ribs and joints by hot rolling, the rolling method disclosed in JP 3491129 B2, for example, which was previously proposed by the applicants, can be used. Specifically, a four-roll rolling mill with two sets of rollers disposed orthogonally, as illustrated in FIG. 6, can be used. A two-roll rolling mill with rollers disposed vertically, as illustrated in FIG. 7, can also be used. When forming ribs by biting via the gap between rollers, the gap between adjacent rollers needs to be controlled accurately so that the dimensions of the ribs satisfy the conditions of the present disclosure. When forming ribs by grooves dug in the rollers, the grooves dug in the rollers gradually wear down during use. The amount of roller wear before rolling therefore needs to be measured and controlled so that the dimensions of the ribs satisfy the conditions of the present disclosure.

EXAMPLES

Example 1

After obtaining steel with the chemical composition listed in Table 1 (steel sample IDs A to G) by steelmaking and forming the steel into billets, deformed reinforcing bars having two ribs disposed diagonally 180° apart were manufactured using a two-roll rolling mill. The deformed reinforcing bars were provided with a deformed shape satisfying the stipulations of JIS G3112 with a nominal diameter of 15.9 mm (identified as D16). The ribs were formed by bite rolling by adjusting the gap between vertical rollers. The rib width difference is listed in Table 2. During rolling, the rolling temperature was selected so as to satisfy the strength level SD345.

For each of the resulting deformed reinforcing bars, the hardness difference and the bendability were evaluated with the following methods. The evaluation results are listed in Table 2. For the deformed reinforcing bars of Sample Nos. 4 to 6, 9, and 10, the deformed reinforcing bars were first wound into a coil and then straightened, after which the hardness and bendability were evaluated. The other deformed reinforcing bars were evaluated directly as straight bars after the rolling.

[Hardness]

The hardness of the deformed reinforcing bar before bending was measured in a cross-section (C cross-section) perpendicular to the longitudinal direction (rolling direction). The measurement was performed using a Vickers hardness meter under the condition of a weight of 1 kg. As the central average hardness, the average value at five points was used, specifically one point at the center of the cross-section and four points at 90° intervals on a 1 mm diameter circle around the center. The periphery of the cross-section was measured completely, specifically at 72 points at 5° intervals. The resulting difference between the maximum and minimum peripheral hardness represented as a ratio with respect to the central average hardness was taken as the hardness difference.

[Bendability]

Figure 8:
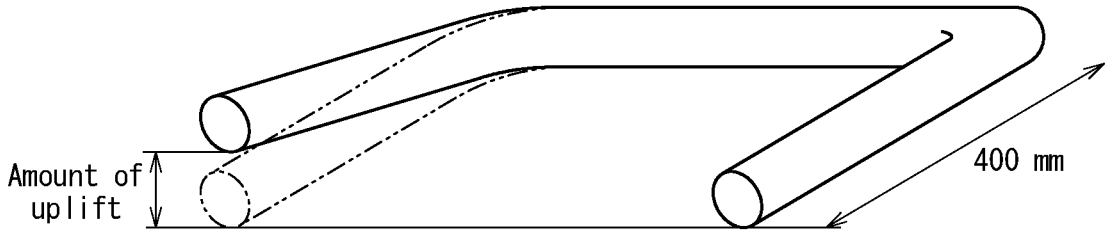
FIG. 8 is a schematic view illustrating a method for measuring the amount of uplift.
Figure 9:
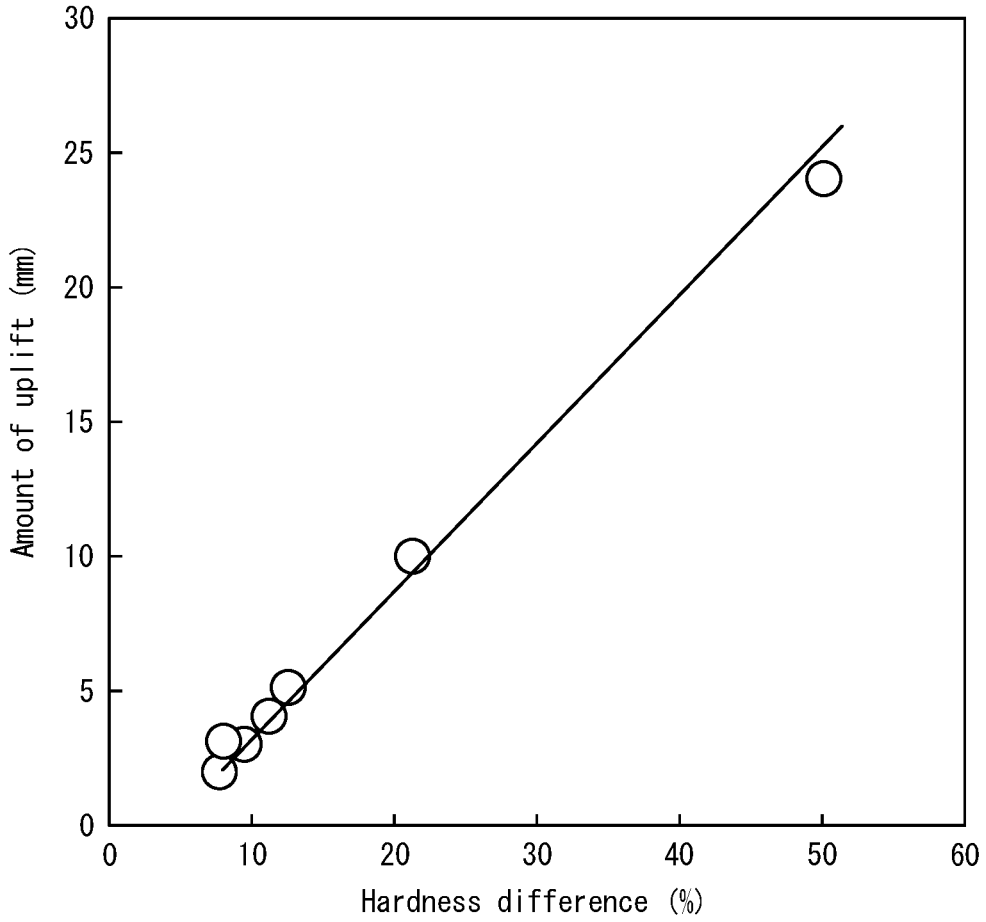
FIG. 9 illustrates the relationship between the hardness difference and the amount of uplift in Example 1.

To evaluate the bendability, each deformed reinforcing bar was cut at a height of 1300 mm, and as illustrated in FIG. 8, was bent 90° at two locations to yield a U shape, with the sides at either end measuring 400 mm. The deformed reinforcing bar was bent under the condition of the radius at the inside of the bend becoming 1.5 times the nominal diameter. After the bending, the presence of cracks inside the bent portion was confirmed, and the amount of uplift at one end was measured as the amount of out-of-plane deformation. FIG. 9 illustrates the relationship between the hardness difference and the amount of uplift, and FIG. 10 illustrates the relationship between the rib width difference and the amount of uplift.

Figure 10:
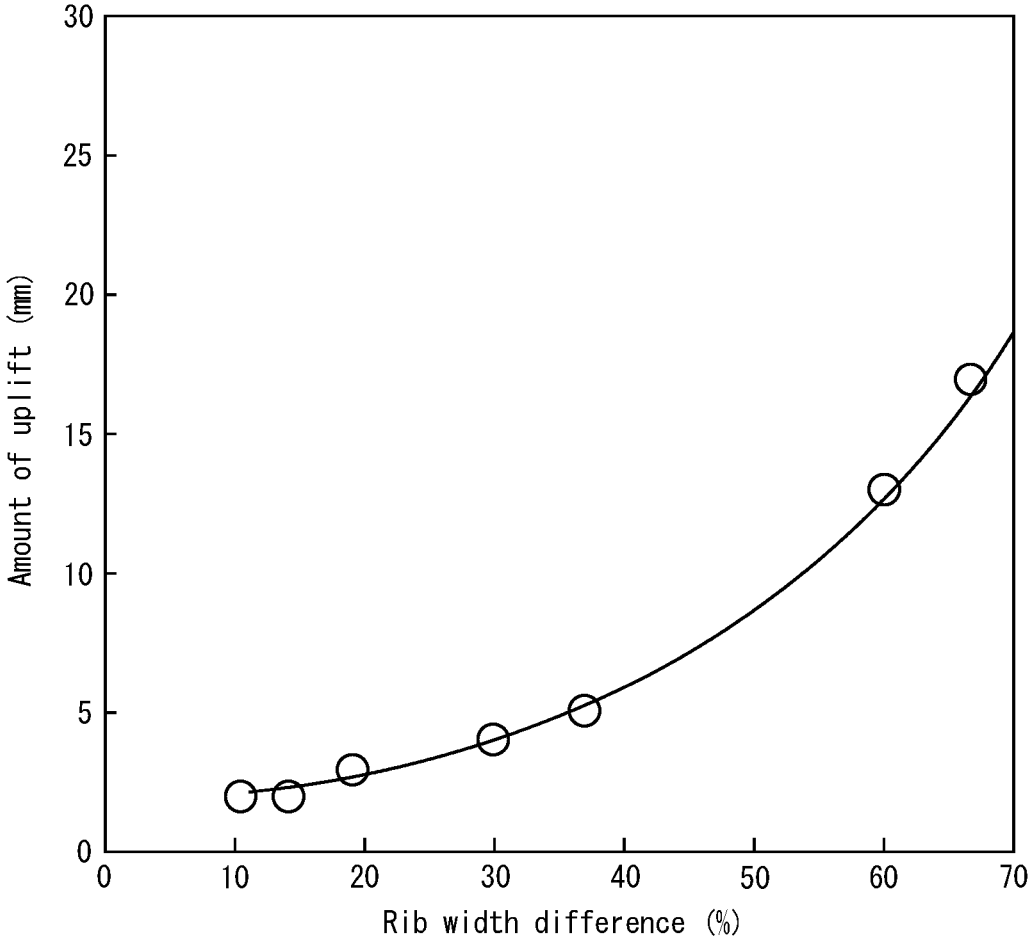
FIG. 10 illustrates the relationship between the rib width difference and the amount of uplift in Example 1.

It is clear from the results illustrated in Table 2, FIG. 9, and FIG. 10 that low out-of-plane deformation and excellent bending workability are obtained when the chemical composition, microstructure, hardness difference, and rib width difference all satisfy the conditions of the present disclosure. By contrast, the bending workability degrades in the Comparative Examples, in which at least one of the chemical composition, microstructure, hardness difference, and rib width difference does not satisfy the conditions of the present disclosure.

TABLE 1

| Steel sample | Chemical composition (mass %)* | | | | | | | | |
|---|---|---|---|---|---|---|---|---|---|
| ID | C | Si | Mn | P | S | Cr | V | Nb | Notes |
| A | 0.99 | 0.36 | 13.4 | 0.016 | 0.039 | 0.10 | — | — | Conforming steel |
| B | 1.01 | 0.34 | 9.1 | 0.010 | 0.047 | 0.31 | — | — | Conforming steel |
| C | 0.73 | 0.30 | 10.2 | 0.010 | 0.033 | 0.12 | — | — | Conforming steel |
| D | 0.73 | 0.02 | 10.7 | 0.013 | 0.004 | 0.01 | 0.46 | — | Conforming steel |
| E | 0.74 | 0.24 | 11.2 | 0.017 | 0.006 | 0.01 | — | 0.12 | Conforming steel |
| F | 1.28 | 0.01 | 9.1 | 0.012 | 0.040 | 0.01 | — | — | Comparative steel |
| G | 0.53 | 0.02 | 13.3 | 0.014 | 0.045 | 0.11 | — | — | Comparative steel |

*Balance consisting of Fe and inevitable impurities

TABLE 2

| Sample No. | Steel sample ID | Microstructure | Straightened | Hardness HV in cross-section perpendicular to length direction: Center | Periphery: Maximum | Periphery: Minimum | Hardness difference (%) | Rib width difference (%) | Cracked upon bending | Amount of uplift (mm) | Notes |
|---|---|---|---|---|---|---|---|---|---|---|---|
| 1 | A | austenite | no | 222 | 229 | 212 | 8 | 14.3 | no | 2 | Example |
| 2 | B | austenite | no | 211 | 224 | 208 | 8 | 10.5 | no | 2 | Example |
| 3 | C | austenite | no | 193 | 209 | 191 | 9 | 19.0 | no | 3 | Example |
| 4 | D | austenite | yes | 242 | 264 | 237 | 11 | 30.0 | no | 4 | Example |
| 5 | E | austenite | yes | 223 | 245 | 217 | 13 | 36.8 | no | 5 | Example |

TABLE 2-continued

| Sample No. | Steel sample ID | Microstructure | Straightened | Hardness HV in cross-section perpendicular to length direction: Center | Periphery: Maximum | Periphery: Minimum | Hardness difference (%) | Rib width difference (%) | Cracked upon bending | Amount of uplift (mm) | Notes |
|---|---|---|---|---|---|---|---|---|---|---|---|
| 6 | D | austenite | yes | 202 | 346 | 330 | 8 | 19.0 | no | 3 | Example |
| 7 | F | austenite + group carbides | no | 303 | 315 | 300 | 5 | 15.0 | yes | — | Comparative Example |
| 8 | G | austenite + martensite | no | 261 | 368 | 201 | 64 | 4.8 | yes | — | Comparative Example |
| 9 | A | austenite | yes | 219 | 314 | 204 | 50 | 14.3 | no | 24 | Comparative Example |
| 10 | A | austenite | yes | 220 | 264 | 217 | 21 | 14.3 | no | 10 | Comparative Example |
| 11 | A | austenite | no | 217 | 230 | 212 | 8 | 60.0 | no | 13 | Comparative Example |
| 12 | A | austenite | no | 215 | 228 | 210 | 8 | 66.7 | no | 17 | Comparative Example |

Example 2

Figure 11:
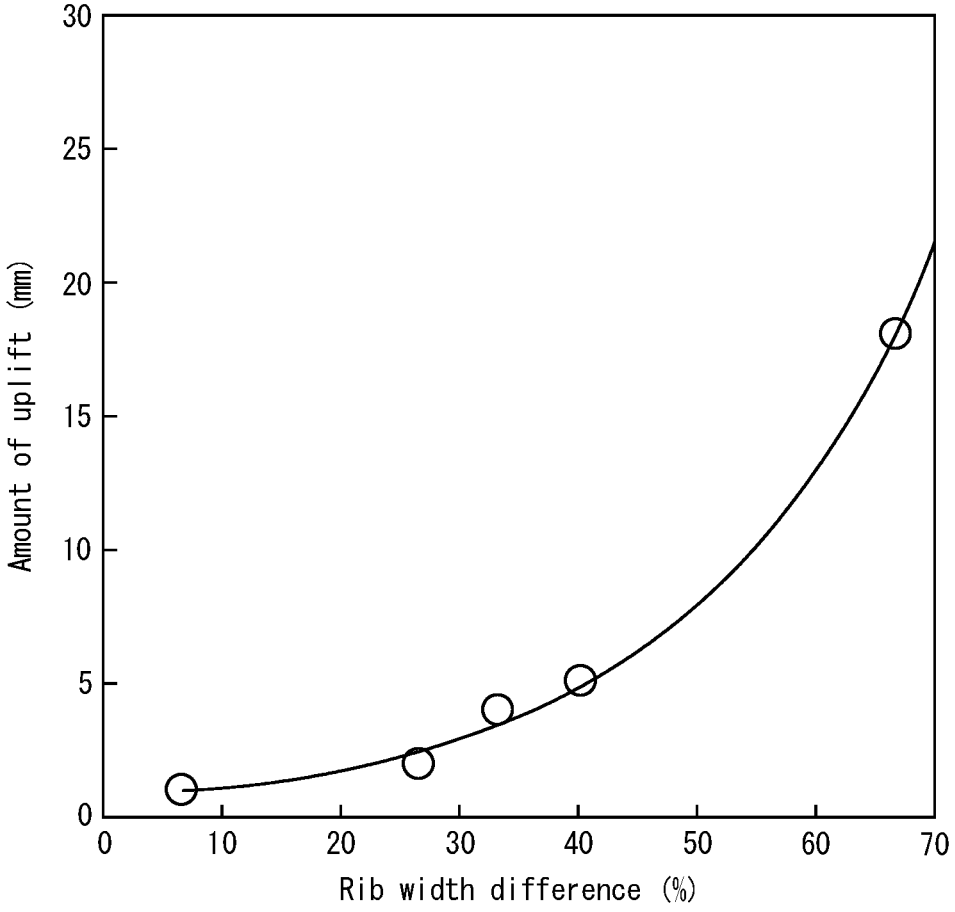
FIG. 11 illustrates the relationship between the rib width difference and the amount of uplift in Example 2.

Next, using the steel with steel sample ID A in Table 1, deformed reinforcing bars having four ribs at 90° intervals, a nominal diameter of 12.7 mm (identified as D13), and a strength level SD345 were manufactured by straight bar rolling. During the rolling, a four-roll rolling mill with two pairs of rollers arranged orthogonally was used, the gap between adjacent rollers was adjusted, and bite rolling was performed to form the ribs. The rib width and the distance between apices of diagonal ribs were as listed in Table 3. The rib width and distance between apices of diagonal ribs were adjusted by controlling the bite amount through a change in the gap between the up-down and left-right rollers and a change in the size of the material before entering the deformed shape transfer rollers. The reduction in area before and after the roller pass for deformed shape transfer was set to be 40% or less and was adjusted within a range avoiding an unreasonable cross-sectional hardness difference. The evaluation of bending was conducted with the same method as Example 1, and the results are listed in Table 3. FIG. 11 illustrates the relationship between the rib width difference and the amount of uplift, and FIG. 12 illustrates the relationship between the difference in distance between apices of diagonal ribs and the amount of uplift.

Figure 12:
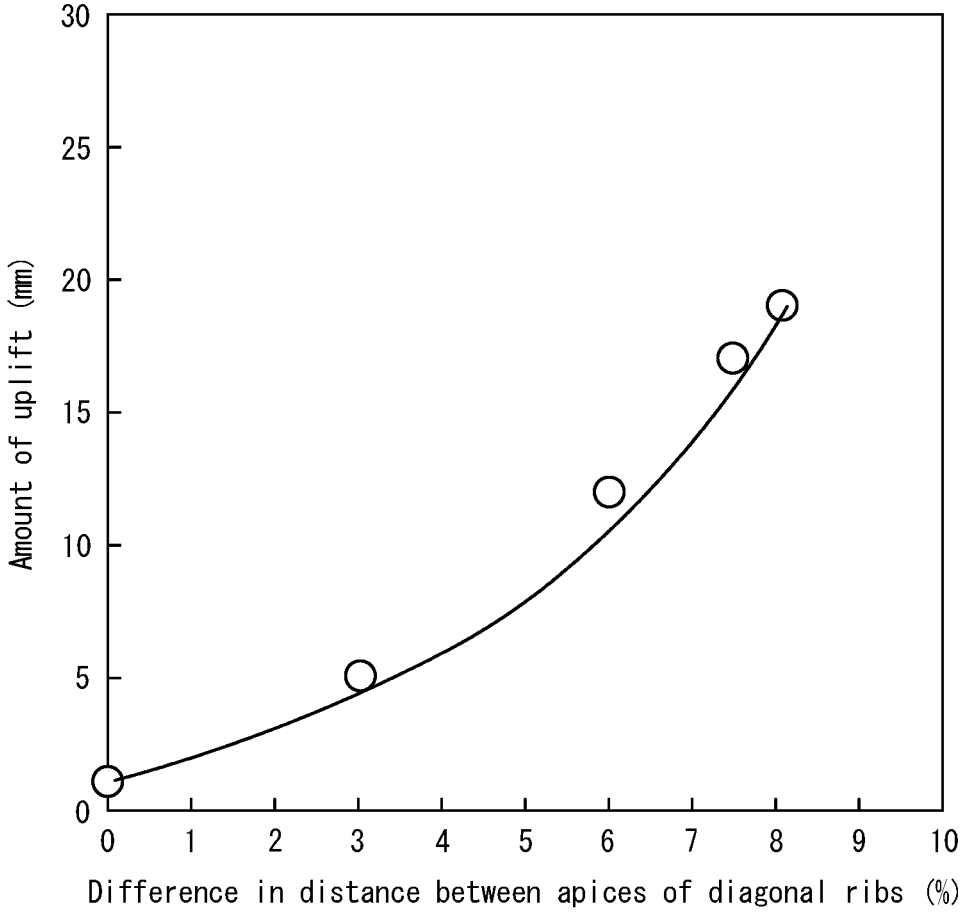
FIG. 12 illustrates the relationship between the difference in distance between apices of diagonal ribs and the amount of uplift in Example 2.

It is clear from the results illustrated in Table 3, FIG. 11, and FIG. 12 that low out-of-plane deformation and excellent bending workability are obtained when the rib shape satisfies the conditions of the present disclosure. By contrast, the bending workability degrades in the Comparative Examples, which do not satisfy the conditions of the present disclosure.

TABLE 3

| Sample No. | Steel sample ID | Microstructure | Straightened | Hardness difference (%) | Rib width: Up-down ribs (mm) | Rib width: Left-right ribs (mm) | Rib width difference (%) |
|---|---|---|---|---|---|---|---|
| 13 | A | austenite | no | 5 | 1.5 | 1.6 | 6.7 |
| 14 | A | austenite | no | 5 | 1.5 | 1.9 | 26.7 |
| 15 | A | austenite | no | 8 | 1.5 | 2.0 | 33.3 |
| 16 | A | austenite | no | 8 | 1.5 | 2.1 | 40.0 |
| 17 | A | austenite | no | 5 | 1.5 | 2.5 | 66.7 |
| 18 | A | austenite | no | 6 | 1.5 | 1.6 | 6.7 |
| 19 | A | austenite | no | 8 | 1.5 | 1.6 | 6.7 |
| 20 | A | austenite | no | 5 | 1.5 | 1.6 | 6.7 |
| 21 | A | austenite | no | 8 | 1.5 | 1.6 | 6.7 |

| Sample No. | Distance between apices of diagonal ribs: Between up-down ribs (mm) | Between left-right ribs (mm) | Difference in distance between apices of diagonal ribs (%) | Cracked upon bending | Amount of uplift (mm) | Notes |
|---|---|---|---|---|---|---|
| 13 | 12.7 | 12.7 | 0.0 | no | 1 | Example |
| 14 | 12.7 | 12.7 | 0.0 | no | 2 | Example |
| 15 | 12.7 | 12.4 | 2.4 | no | 4 | Example |
| 16 | 12.7 | 12.7 | 0.0 | no | 5 | Example |
| 17 | 12.7 | 12.7 | 0.0 | no | 18 | Comparative Example |
| 18 | 13.1 | 12.7 | 3.1 | no | 5 | Example |
| 19 | 13.3 | 12.5 | 6.4 | no | 12 | Comparative Example |

TABLE 3-continued

| | | | | | | |
|---|---|---|---|---|---|---|
| 20 | 13.4 | 12.4 | 8.1 | no | 17 | Comparative Example |
| 21 | 13.6 | 12.5 | 8.8 | no | 19 | Comparative Example |

The invention claimed is:

1. A deformed reinforcing bar comprising:

a chemical composition containing, in mass %,

C: 0.7% or more and 1.2% or less,

Si: 1.0% or less,

Mn: 9% or more and 15% or less,

Cr: 1.0% or less,

P: 0.03% or less, and

S: 0.05% or less, the balance consisting of Fe and inevitable impurities; and a microstructure comprising an austenite single phase; wherein in terms of Vickers hardness, a ratio of a difference between a maximum hardness and a minimum hardness at a periphery of a cross-section perpendicular to the longitudinal direction with respect to a central average hardness is 15% or less, two or more ribs extending in the longitudinal direction are provided at equal intervals in a cross-sectional circumferential direction, and a ratio of a difference between a maximum width and a minimum width of the ribs with respect to the minimum width is 50% or less.

2. The deformed reinforcing bar of claim 1, wherein the chemical composition further contains, in mass %, one or more of:

V: 1.0% or less, and

Nb: 0.2% or less.

3. The deformed reinforcing bar of claim 1, wherein the number of ribs is an even number equal to or greater than four, and a ratio of a difference between a maximum distance and a minimum distance between apices of diagonal ribs with respect to the minimum distance is 5% or less.

4. The deformed reinforcing bar of claim 2, wherein the number of ribs is an even number equal to or greater than four, and a ratio of a difference between a maximum distance and a minimum distance between apices of diagonal ribs with respect to the minimum distance is 5% or less.

* * * * *